US005722360A

United States Patent [19]

Tsunoda et al.

[11] Patent Number: 5,722,360

[45] Date of Patent: Mar. 3, 1998

[54] ENGINE ASSEMBLY

[75] Inventors: Masaki Tsunoda; Mitsuharu Tanaka, both of Wako, Japan

[73] Assignee: Honda Giken Kogyo Kabushiki Kaisha, Tokyo, Japan

[21] Appl. No.: 535,642

[22] Filed: Sep. 28, 1995

[30] Foreign Application Priority Data

Sep. 28, 1994 [JP] Japan ..... 6-233818
Sep. 30, 1994 [JP] Japan ..... 6-237991

[51] Int. Cl.[6] ..... F02F 7/00

[52] U.S. Cl. ..... 123/195 P; 123/198 E; 123/185.1; 440/85; 440/900

[58] Field of Search ..... 123/198 E, 195 C, 123/185.1, 195 P; 440/88, 85, 900

[56] References Cited

U.S. PATENT DOCUMENTS 5,445,547 8/1995 Furukawa ..... 440/88

FOREIGN PATENT DOCUMENTS 59-100093 6/1984 Japan .
4-353223 12/1992 Japan .

*Primary Examiner*—Noah P. Kamen

*Attorney, Agent, or Firm*—Merchant, Gould, Smith, Edell, Welter & Schmidt, P.A.

[57] ABSTRACT

A disclosed engine assembly comprises an engine; a crank shaft having an end extending outward from inside the engine; a rotating body mounted at the end of the crank shaft; a cover body mounted on the engine so as to cover the rotating body; the cover body comprising a lower cover that covers at least lower part of the rotating body and an upper cover connected to the lower cover so as to cover at least upper part of the rotating body; the lower cover having at least one ventilating intake port for sucking hot air located around the engine under the intake port; the upper cover having a ventilating exhaust duct for discharging the sucked hot air; the rotating body including a timing belt located near one side of the engine, a tensioner located near one side of the engine and having a mounting position adjustment bolt for adjusting a tension on the timing belt, and a manually starting pulley located on one side of the engine outside the timing belt; and the starting pulley having at least one opening located so as to engage with the amounting position adjustment bolt of the tensioner. This constitution enables hot air existing around the engine under the lower cover to be discharged smoothly to the outside of the engine cover via the cover body, thereby preventing hot air from being stranded under the lower cover. In addition, the position of the mounting position adjustment bolt can be perceived easily by simply aligning the opening with the bolt.

7 Claims, 10 Drawing Sheets

ENGINE ASSEMBLY

BACKGROUND OF THE INVENTION

1. Field of the invention

This invention generally relates to a vertical engine for an outboard motor, and in particular, to a cover structure that covers a rotating body provided at the upper end of a crank shaft on the engine and a manually starting pulley constituting part of the rotating body.

2. Description of the Related Art

A vertical engine including a rotating body comprising a drive pulley and a driven pulley mounted at the upper end of a crank shaft protruding upward from a crank case and a cam shaft, respectively, and a timing belt extending between the drive pulley and the driven pulley is publicly known from Japanese Patent Laid-Open Publication SHO 59-100093 and Japanese Patent Laid-Open Publication HEI 4-353223.

The engine disclosed in Japanese Patent Laid-Open Publication SHO 59-100093 includes a fly wheel at the upper end of the crank shaft located further from the engine that the drive pulley, with the fly wheel covered by a cover body together with the rotating body, as shown in FIG. 3 of this publication. The cover body comprises a plate-like lower cover 51 and an upper cover 54 connected to the lower cover 51 so as to cover the top of the lower cover 51 and having a ventilating exhaust duct 55 for discharging hot air in the cover body. In this configuration, however, the hot air around the engine is often stranded under the lower cover, and the stranded hot air rises from around the cover body and is then sucked into the engine again with fresh air from an intake opening in the upper part of the engine.

The engine disclosed in Japanese Patent Laid-Open Publication HEI 4-353223 includes a belt tensioner 39 disposed between a crank shaft 5 and a cam shaft 34 for adjusting a tension on a timing belt 38 with a fly wheel 41 provided over the belt tensioner 39 (opposite to the engine) in such a way that the fly wheel 41 overlaps the belt tensioner 39, as shown in FIGS. 4 and 5 of this publication. In this configuration with the fly wheel 41 disposed over the belt tensioner 39 so as to overlap it, when the belt tensioner 39 is moved to adjust the tension on the timing belt 38, the position of a mounting position adjustment belt for fixing the belt tensioner 39 in the middle position cannot be confirmed easily. Thus, this configuration does not enable adjustment to be carried out easily.

It is thus an object of this invention to provide a constitution to which a cover body with a lower cover is applied and wherein hot air is prevented from being stranded under the lower cover.

It is another object of this invention to enable a tensioner for adjusting a tension on a timing belt to be adjusted easily even if some structure is placed over the tensioner.

SUMMARY OF THE INVENTION

To achieve the above object, a first notion of this invention provides an engine assembly comprising an engine, a crank shaft having an end extending outward from inside the engine, a rotating body mounted at said end of the crank shaft, a cover body mounted on the engine so as to cover the rotating body, the cover body comprising a lower cover that covers at least lower part of the rotating body and an upper cover connected to the lower cover so as to cover at least part of the rotating body, the lower cover having at least one ventilating intake port for sucking hot air located around the engine under the intake port, and the upper cover having a ventilating exhaust duct for discharging the sucked hot air.

When the lower cover and the upper cover are fitted together, an exhaust path is formed therebetween.

The rotating body includes a generator rotor mounted at the upper end of the crank shaft, and a manually starting pulley mounted on one side of the generator rotor which is far from the engine. The starting pulley has a larger diameter than the generator rotor and also has a blade provided on its upper part.

A second notion of this invention provides an engine assembly comprising an engine, a crank shaft having an end extending outward from inside the engine, a rotating body mounted at said end of the crank shaft, the rotating body including a timing belt located near one side of the engine, a tensioner located near one side of the engine and having a mounting position adjustment bolt for adjusting a tension on the timing belt, and a manually starting pulley located on one side of the engine outside the timing belt, the starting pulley having at least one opening located so as to engage with the amounting position adjustment bolt of the tensioner.

The engine includes a fly wheel mounted on the other side thereof.

The manually starting pulley is mounted on one side of the generator rotor mounted on one side of the engine via a mounting bolt outside the outer diameter of the crank shaft, said side of the generator motor opposed to the engine. The opening in the pulley is provided outside the outer diameter of the generator rotor.

DETAILED DESCRIPTION OF THE PREFERRED EMBODIMENTS

Figure 1:
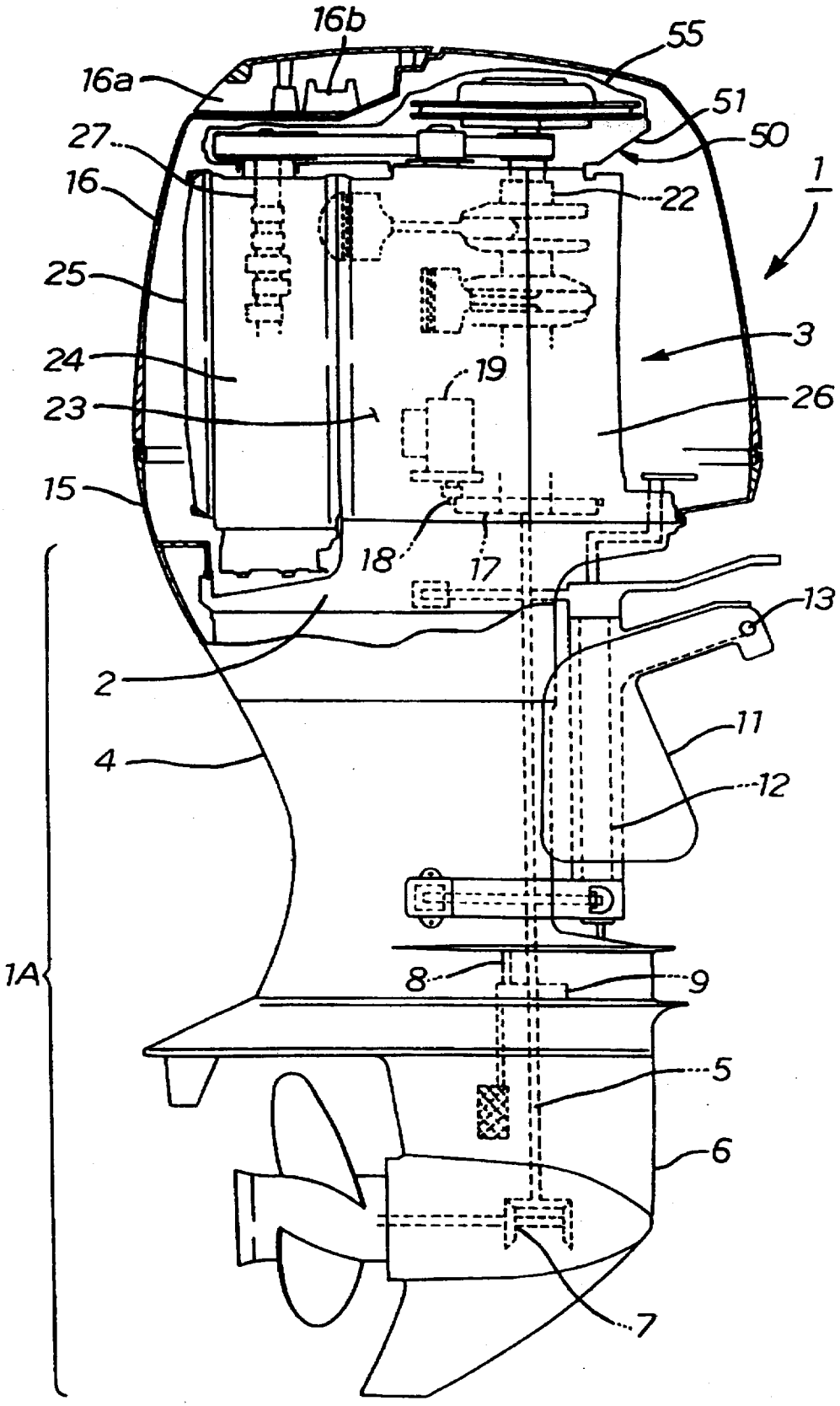
FIG. 1 is a side cross section of the integral part of an outboard motor according to this invention.

A preferred embodiment of this invention is described below in detail with reference to the accompanying drawings.

First, an embodiment according to a first notion of this invention is described in detail with reference to FIGS. 1 to 7. Referencing FIG. 1 that is a cross section showing the integral part of an outboard motor according to this invention, as seen laterally, an outboard motor 1 comprises an outboard motor main body 1A comprising a vertical multicylinder engine 3 placed on a mount case 2 and coupled thereto with bolts, an extension case 4 coupled to the bottom of the mount case 2 with bolts, a vertical drive shaft 5 housed in the extension case 4, a bevel gear set 7 housed in a gear case 6 bonded to the bottom of the extension case 4, and a cooling water supply pipe 8 and a water pump 9 housed in the extension case 4 and gear case 6; and an outboard motor mounting means 11 elastically supported by and coupled to the outboard motor 1A via a mount rubber.

The outboard motor mounting means 11 is a fixture for fixing the outboard motor 1 to a hull not shown, and can oscillate the outboard motor main body 1A around a swivel shaft 12 in the lateral direction as shown from above and spring the outboard motor main body 1A including the swivel shaft 12 clockwise in the drawing around a tilt shaft 13.

The outboard motor main body 1A also includes an under case 15 that forms an engine room that accommodates an engine 3, and an engine cover 16 that can be attached to and removed from the under case 15. The under case 15 is supported by the mount case 2. Reference numeral 16*a* designates an air intake port which finally leads to the intake port of the engine 3 via an air intake duct 16*b*.

A fly wheel 17 is mounted below a crank shaft 22, and linked to a starter motor 19 via a ring gear 18 provided on the outer diameter of the fly wheel 17.

Figure 2:
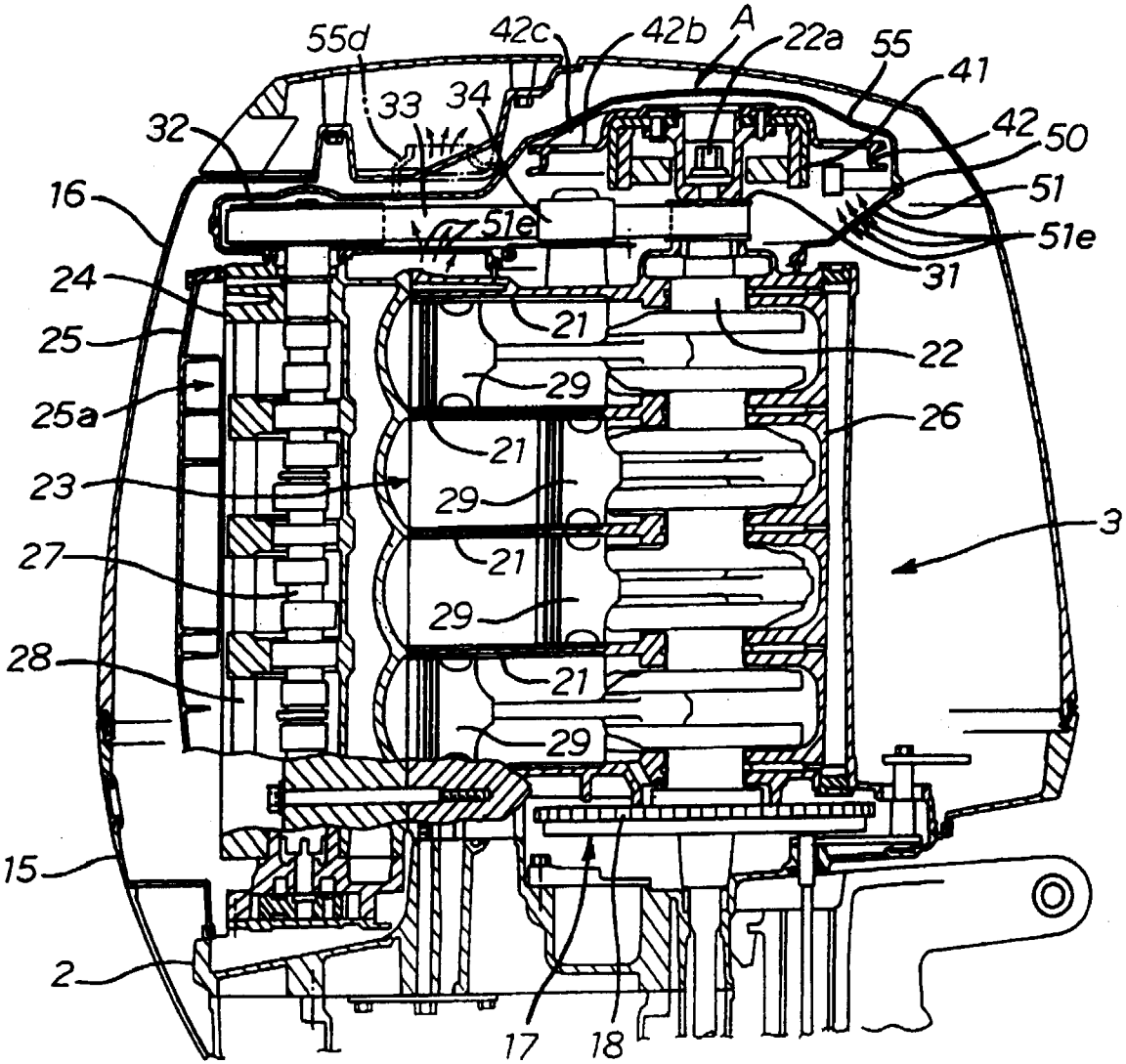
FIG. 2 is a side cross section of a vertical engine to which a first embodiment of this invention is applied.

FIG. 2 is a side cross section of a vertical multicylinder engine according to a first embodiment of this invention. This vertical multicylinder engine 3 comprises, for example, a four cylinder engine with each cylinder 21 . . . ( . . . indicates a plurality. This is applicable throughout the specification) arranged so that its axes extend approximately horizontally. A crank shaft 22 is vertically arranged. A cylinder block 2S and a cylinder block 24 are joined together on an approximately vertical surface, and a movable valve chamber 25*a* comprising a cylinder head 24 and a head cover 25 has a cam shaft 27 and a locker shaft 28 housed therein.

Reference numerals 26 and 29 designate pistons inserted into a crank case and the cylinder 21. Although not shown, the inside of the cylinder block 23 is in communication with the movable valve chamber 25*a*.

The upper part of the crank shaft 22 protrudes from the cylinder block 23, while the upper part of the cam shaft 27 protrudes from the cylinder head 24.

A timing belt 33 is installed between a crank shaft pulley 31 mounted on the top of the crank shaft 22 and a cam shaft pulley 32 mounted on the top of the cam shaft 27, with an appropriate tension applied to the timing belt 33 via a timing belt tensioner 34.

A manually starting pulley 42 is mounted on the top of the crank shaft 22 (one side of the engine 3) outside the timing belt 33 (opposite to the engine) via a (AC) generator rotor 41.

The diameter of a rotor 41 is larger than that of the crank shaft 22 and smaller than that of a fly wheel 17 described below, and the rotor 41 has an inverted U shape that opens downward. The rotor 41 is attached to the crank shaft 22 via a bolt 22*a* in such a way that the rotor 41 and the crank shaft 22 rotate simultaneously.

The crank shaft pulley 31, the cam shaft pulley 32, the timing belt 33, the tensioner 34, the rotor 41, and the manually starting pulley 42 are covered by a cover body 50 comprising an upper cover 55 and a lower cover 51.

The crank shaft 22 has the fly wheel 17 attached to the lower part thereof (the other side of the engine 3) and the fly wheel 17 is linked to the starter motor 19 (FIG. 1) with the ring gear 18 provided on the outer circumference thereof.

The crank shaft pulley 31, the timing belt 33, the rotor 41, and the manually starting pulley 42 are collectively referred to as a "rotating body A" mounted at the upper end of the crank shaft 22.

Figure 3:
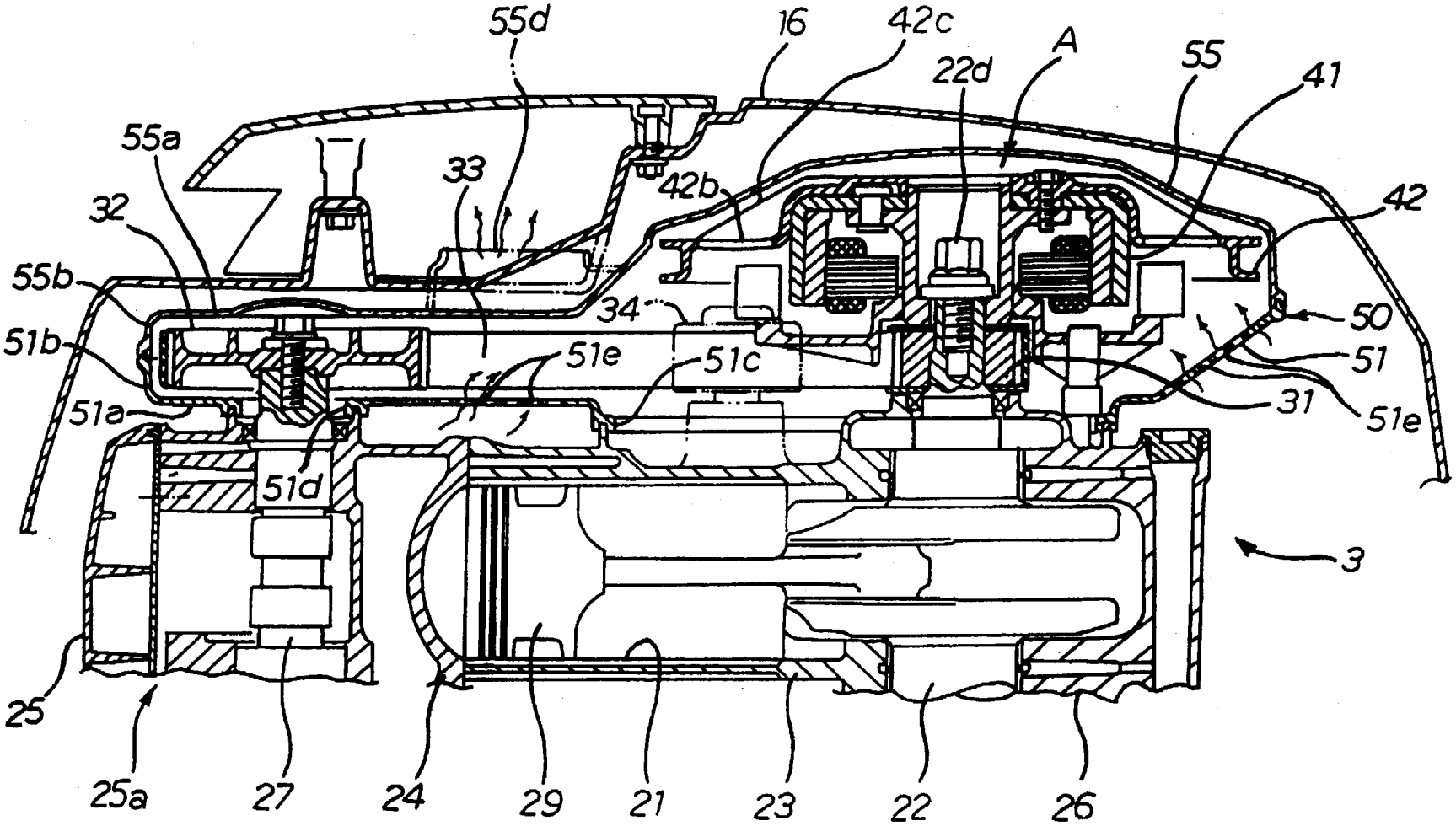
FIG. 3 is an enlarged detailed drawing showing the upper part of the engine shown in FIG. 2.

FIG. 3 is an enlarged detailed drawing showing the upper part of the engine shown in FIG. 2. The cover body 50 comprises a lower cover 51 mounted on the cylinder block 23 so as to cover at least part of the rotating body A and an upper cover 55 attached to the lower cover 51 so as to cover at least the upper part of the rotating body A.

The lower cover 51 comprises a bottom 51*a*, a peripheral wall 51*b* installed so as to surround the bottom 51*a*, a first aperture 51*c* and a second aperture 51*d* opened in the bottom 51*a*, and a plurality of ventilating intake ports 51*e* . . . ( . . . indicates a plurality. This is applicable throughout the specification) suitably opened around the first aperture 51*c* at the bottom 51*a*.

The first aperture 51*c* allows the crank shaft 22 and the tensioner 34 to be inserted thereinto, and the second aperture 51*d* allows the cam shaft 27 to be inserted thereinto.

The cover body 50 are mounted on the cylinder block 23, the cylinder head 24, and the crank case 26 by fitting to their upper ends the edge of the lower cover 51 that defines the first aperture 51*c* and the second aperture 51*d*. Part of the bottom 51*a* extends obliquely upward to form the peripheral wall.

The upper cover 55 is shaped so as to correspond to the lower cover 51 as seen from above, and comprise a hood 55*a* and a peripheral wall 55*b* surrounding the hood 55*a*.

Figure 4:
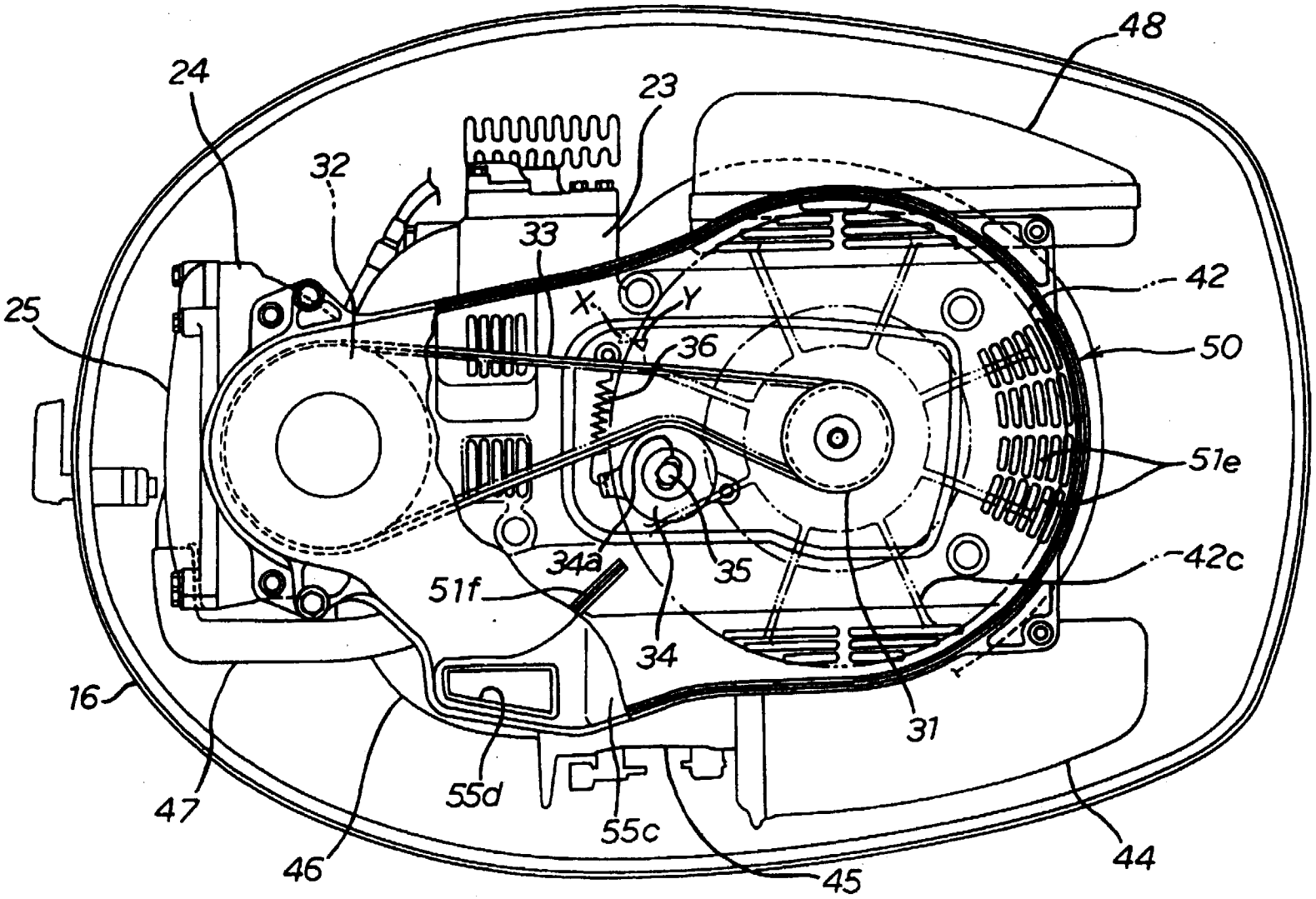
FIG. 4 is a plan showing the vertical multicylinder engine shown in FIG. 2 with an engine cover, a generator rotor, and a manually starting pulley removed.

FIG. 4 is a plan showing the vertical multicylidenr engine in FIG. 2 with the engine cover, the generator rotor, and the manually starting pulley removed. As shown in the figure, the tensioner 34 is mounted on the upper outer surface of the cylinder block 23 with a mounting position adjustment bolt 35 for adjusting a tension on the timing belt 33. The tension on the timing belt 33 can be adjusted by adjusting the engaging lock relationship between the mounting position adjustment bolt 35 and a long aperture 34*a* in the tensioner 34.

Reference numeral 36 designates a coil spring that urges the tensioner 34 against the timing belt 33.

An intake muffling box 44, throttle valve devices 45 the number of which is the same as that of the cylinders, and an intake manifold 46 are disposed on one side of the cylinder block 23.

Reference numerals 47 and 48 designate a blowy gas reflux tube in communication with the head cover 25 and the intake muffling box 44 and an electrical equipment box for housing an ignition coil and a CDI unit.

Figure 5A:
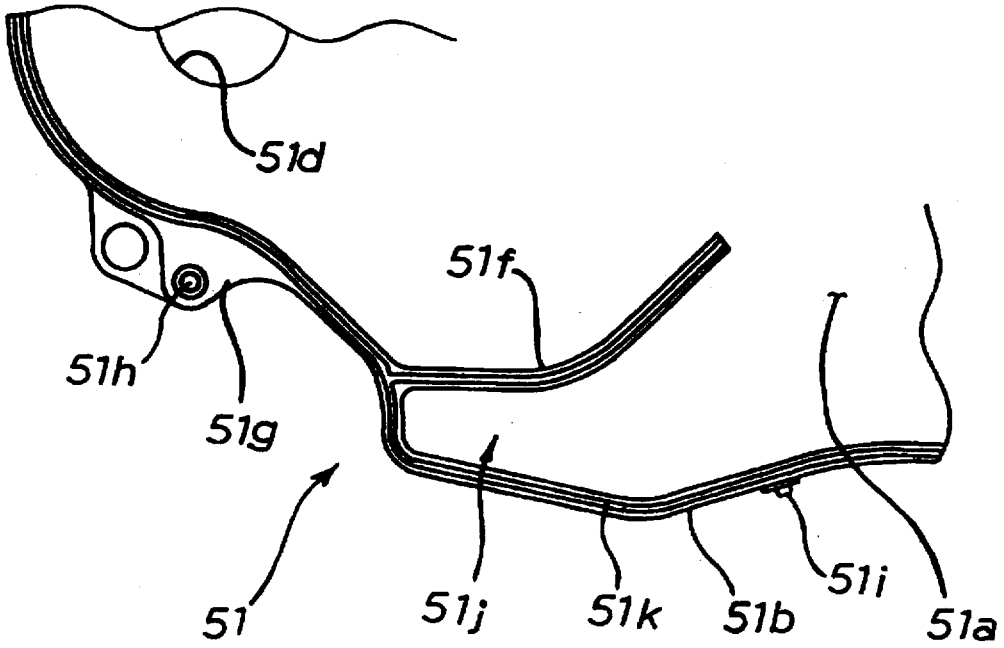
FIGS. 5A and 5B are plans of the integral part of a lower cover and an upper cover that constitute a cover body to the first embodiment of this invention.
Figure 5B:
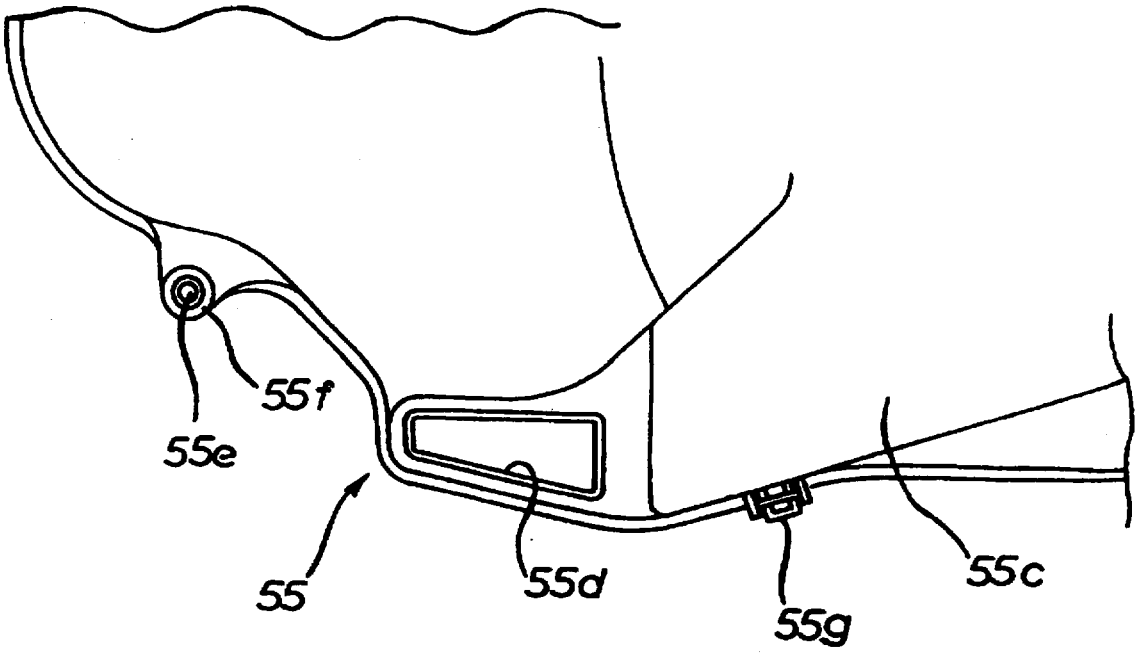

FIGS. 5A and 5B are plans showing the integral part of the lower and upper covers according to the first embodiment of this invention, respectively. As shown in FIG. 5A, the lower cover 51 comprises a bulkhead section 51*f* extending inward from a peripheral wall section 51*b* so as to stand from the bottom 51*a*, a plurality of flanges 51*g* . . . formed on the outer surface of the peripheral wall section 51*b*, bolt locking apertures 51*h* . . . opened in the flanges 51*g* . . . and a plurality of engagingly locking convexes 51*i* . . . formed on the outer surface of the peripheral wall section 51*b*.

The space formed between the peripheral wall section 51b and the bulkhead section 51f is a lower exhaust path 51j constituting part of a ventilating exhaust duct described below.

As shown in FIG. 5B, the upper cover 55 comprises an upper exhaust path 55c extending opposite to the lower exhaust path 51j of the lower cover 51, a ventilating exhaust duct 55d that opens upward at the tip of the upper exhaust path 55c, flanges 55f having bolt looking apertures 55e . . . formed and located so as to correspond to the bolt locking apertures 51h . . . in the lower cover 51, and a fitting recess 55g that is snap-fitted to the engagingly locking convex 51i of the lower cover 51. Before detailed explanation of the configuration of the cover body 50, it should be noted that at least some of the ventilating intake ports 51e . . . (FIG. 3) may be desirably provided in the lower cover 51 and that some of them may be provided in the upper cover 55.

At least part of the ventilating exhaust duct 55d may be desirably provided in the upper cover 55 and that part of it may be provided in the lower cover 51.

In addition, the ventilating exhaust duct 55d is partially provided in the lower cover 51, and cooperate with the upper cover 55 to form an exhaust path. That is, this exhaust path is formed by the cooperation between the lower exhaust path 51j and the upper exhaust path 55c when the lower cover 51 is placed on the upper cover 55.

Figure 6:
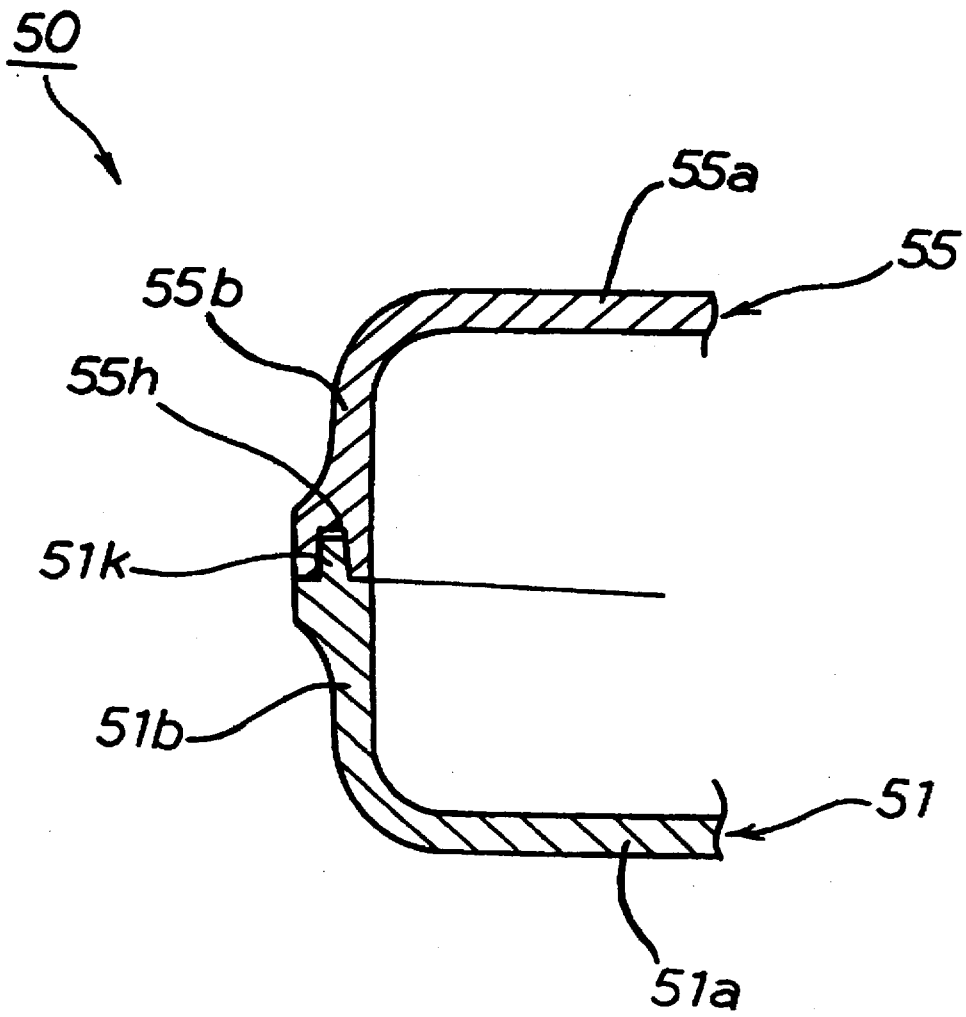
FIG. 6 is a GROSS section of the connection between the lower cover and the upper cover.

FIG. 6 shows in cross section the connection between the lower cover 51 and the upper cover 55 according to the first embodiment of this invention. The lower cover 51 has a convex 51k at the upper edge of the peripheral wall section 51b thereof, while the upper cover 55 has formed at the lower edge of the peripheral wall section 55b thereof a recess 55h in which the convex 51k of the peripheral wall section 51b is fitted, so that the lower cover 51 and the upper cover 55 can be aligned or coupled together easily.

Figure 7A:
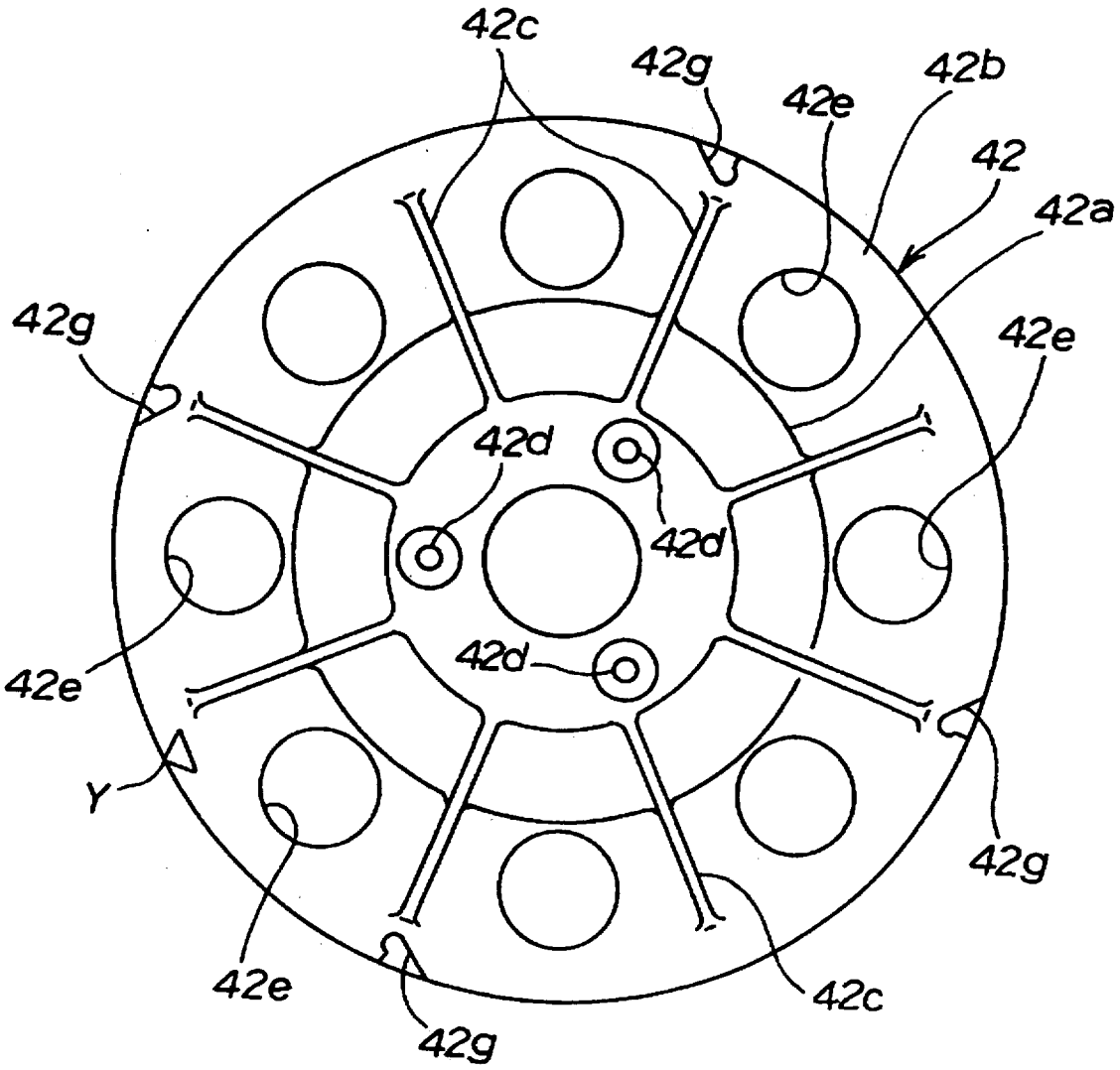
FIGS. 7A and 7B describe the constitution of the manually starting pulley according to the first embodiment of this invention.
Figure 7B:
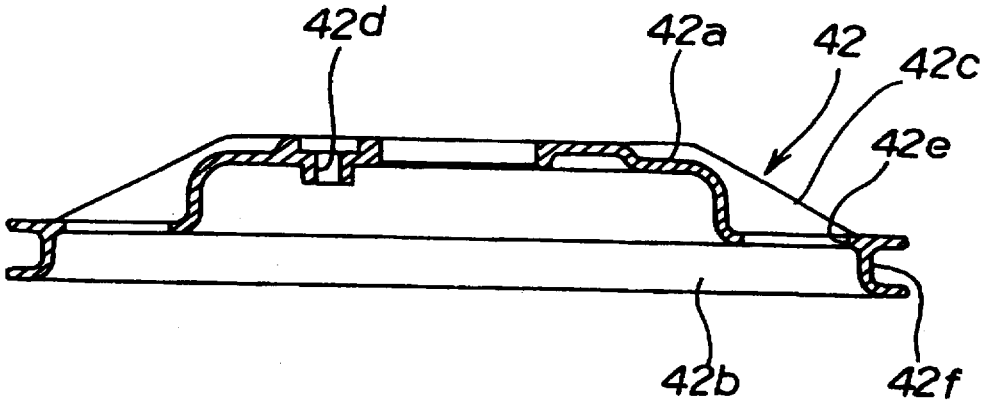

FIGS. 7A and 7B show the configuration of the manually starting pulley according to the first embodiment of this invention in plan and cross section, respectively.

The manually starting pulley 42 comprises a base 42a located in the middle and formed so as to have a larger diameter than the generator rotor 41 (FIG. 3) and an approximately inverted U shape as seen laterally, a disc-like pulley section 42b formed on the lower outer circumference of the base 42a, a plurality of reinforcing ribs 42c . . . radially formed from the outer circumference of the base 42a to the neighborhood of the outer circumference of the pulley section 42b, a plurality of bolt insertion apertures 42d . . . formed in the upper surface of the base 42a, a plurality of openings (round apertures) 42e . . . vertically penetrating the pulley section 42b, a winding groove 42f formed in the outer circumference of the pulley section 42b, and a plurality of hook recesses 42g formed on the outer circumference of the upper surface of the pulley section 42b.

The reinforcing ribs 42c . . . appear vertical plates as seen from above. The bolt insertion apertures 42d . . . allow the insertion thereinto of a bolt for fixing a starting pulley to the generator rotor 41. The openings 42e . . . are arranged outside the outer diameter of the rotor 41. The winding groove 42f allows a starting rope (not shown) to be wound therearound, and the hook recesses 42g allow the end of the starting rope to be engagingly locked therein. The reinforcing ribs 42c . . . also act as a blade of a fan.

The bolt insertion apertures 42d . . . correspond to mounting bolt apertures provided in the rotor 41 outside the diameter of the crank shaft 22.

In addition, the plurality of openings 42e . . . are disposed at a pitch that enables them to engage with the mounting position adjustment bolt 35 of the timing belt tensioner 34.

Furthermore, as shown in FIG. 4, for example, a timing mark X may be provided on the engine block side of the lower cover 51 and a timing mark Y may be provided on the starting pulley 42 so that the opening 42e in the starting pulley 42 can be positioned over the mounting position adjustment bolt 35 by aligning the marks X, Y with each other. The mounting position adjustment bolt 35 varies according to the position of the tensioner 34, and the opening 42e has a width that allows the access and operation of a tool for loosening and tightening the bolt 35. The alignment of the timing marks X, Y enables the crank shaft 22 to be set at the upper dead point.

Next, the operation of the engine of the above configuration is described.

Referencing FIG. 1, the crank shaft 22 is usually started using the a starter motor 19, the ring gear 18, and the fly wheel 17.

In FIG. 3, to manually start the crank shaft 22, the engine cover 16 and the upper cover 55 are removed, the starting rope (not shown) is wound around the manually starting pulley 42, and the pulley is then rotated using the rope.

During the rotation of the crank shaft 22, the rotor 41 also rotates to cause the AC generator to generate electricity.

The cam shaft 27 is accurately driven by the crank shaft 22 via the crank shaft pulley 31, the timing belt 33, and the cam shaft pulley 32.

The timing belt 33 has an appropriate tension applied thereto by the timing belt tensioner 34.

Next, the operation of the cover body 50 is described with reference to FIG. 3.

Hot air existing around the engine 3 under the lower cover 51 enters the ventilating intake ports 51e . . . , passes through the cover body 50 and the exhaust path comprising the lower exhaust path 51j and the upper exhaust path 55c shown in FIGS. 5A and 5B, and is then discharged from the ventilating exhaust duct 55d to the outside of the engine cover 16. This prevents hot air being stranded under the lower cover 51.

In addition, the rotation of the manually starting pulley 42 causes the reinforcing ribs 42c . . . of the manually starting pulley 42 to act as a blade of an exhaust fan to rotate clockwise in FIG. 4, thereby enabling hot air passing through the cover body 50 to be efficiently discharged from the ventilating exhaust duct 55d.

Next, the procedure for adjusting the timing belt tensioner 34 is explained.

First, the engine cover 16 and the upper cover 55 shown in FIG. 3 are removed, and one of the openings 42e . . . is aligned with the mounting position adjustment bolt 35 by manually rotating the manually starting pulley 42 to match the marks X, Y. The position of the mounting position adjustment bolt 35 is confirmed through the opening 42e. Then, the tool is used to access the opening 42e and the lateral bottom of the starting pulley 42 to loosen the mounting position adjustment bolt 35 in order to adjust the position of the tensioner 34, thereby applying an appropriate tension to the timing belt 33. Finally, the mounting position adjustment bolt is tightened, and the upper cover 55 and the engine cover 16 are mounted to complete the adjustment.

A variation of the cover body 50 according to the first embodiment is described with reference to FIG. 8.

Figure 8:
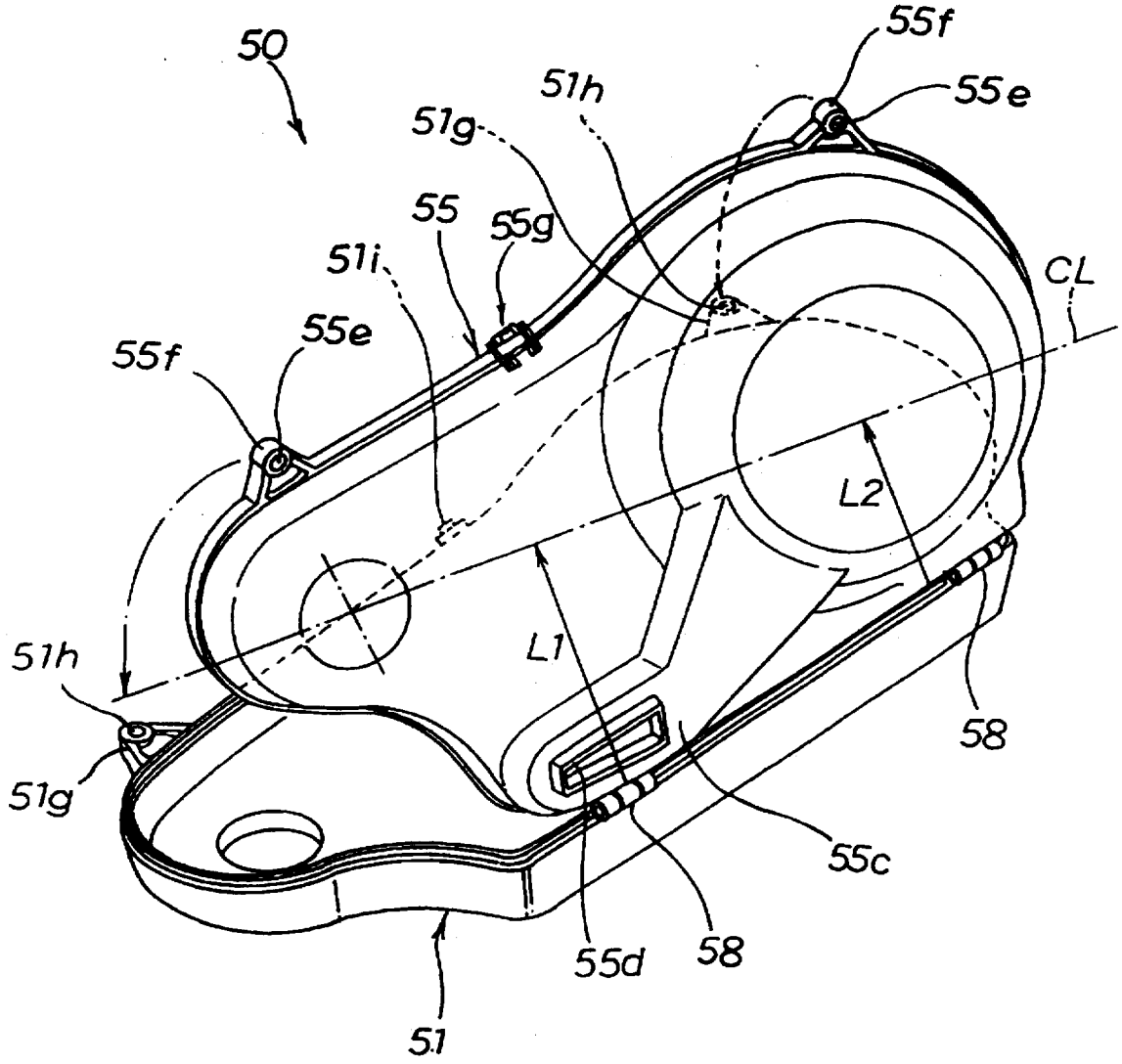
FIG. 8 is a schematic perspective view of a cover body according to a second embodiment of this invention.

FIG. 8 is a schematic perspective view of a cover body according to a second embodiment of this invention. A cover body 50 has a lower cover 51, and an upper cover 55 coupled to the lower cover 51 via hinges 58 . . . . This constitution reduces the number of bolting and snap fitting sites between the lower cover 51 and the upper cover 55, thereby enabling the cover body 50 to be opened and closed easily.

The ventilating exhaust duct 55*d* is located furthest relative to the line segment CL joining the center of the crank shaft 22 with the center of the cam shaft 27 (L1>L2). The upper cover 55 can be widely opened because the hinges 58 . . . are disposed on the side of the upper cover on which the ventilating exhaust duct 55*d* is provided and the fitting recess 55*g* is disposed on the other side of the upper cover opposed to the ventilating exhaust duct 55*d*.

Next, the second embodiment of this invention is described with reference to FIGS. 9 to 10B. The corresponding components carry the same reference numerals as in the first embodiment, and their description is omitted.

Figure 9:
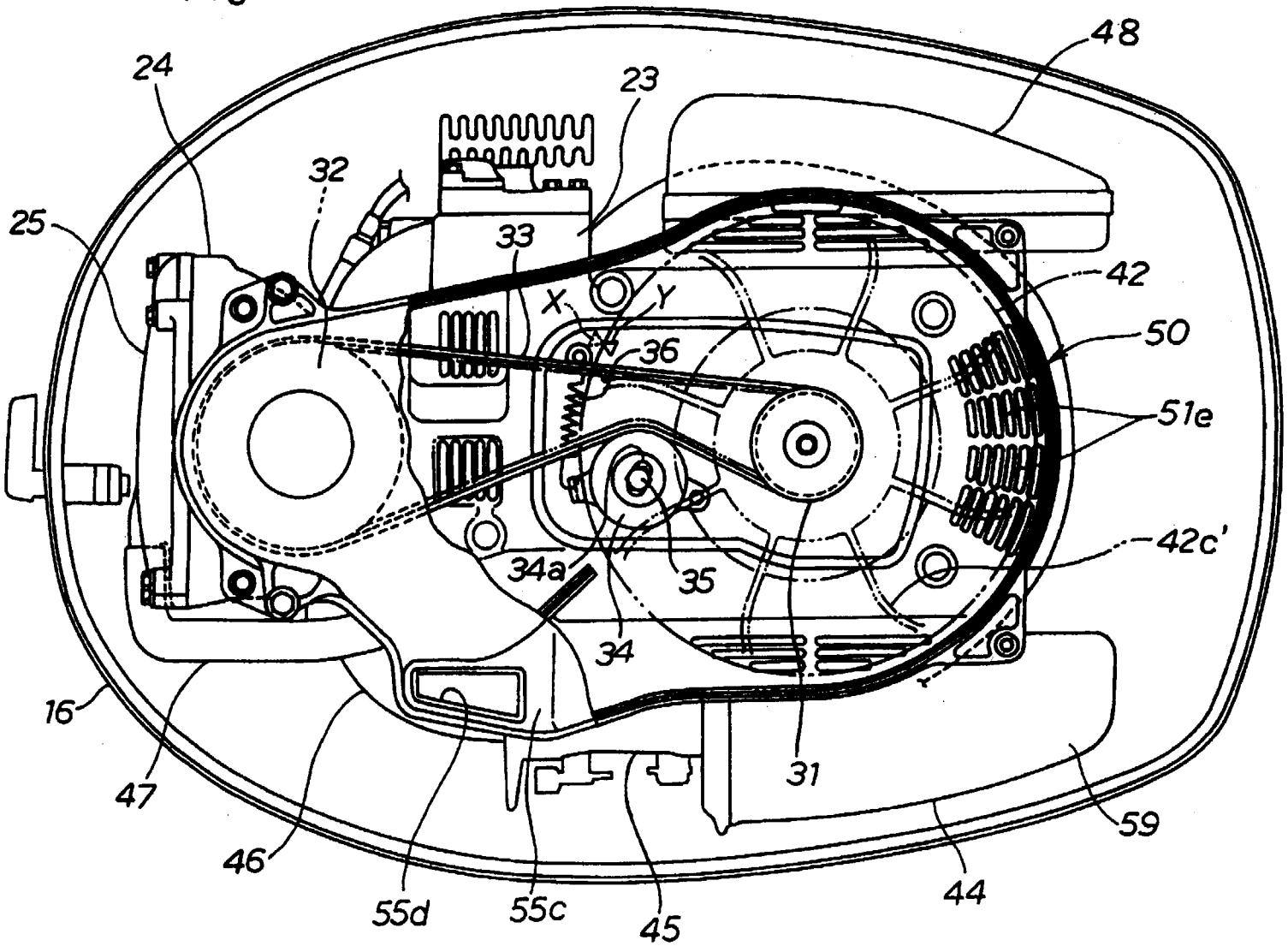
FIG. 9 is a plan showing a vertical multicylinder engine to which the second embodiment of this invention is applied with an engine, a generator rotor, and a manually starting pulley removed.

FIG. 9 is a plan showing a vertical multicylinder engine to which the second embodiment of this invention is applied with an engine cover, a generator rotor, and a manually starting pulley removed.

The rotation of the manually starting pulley 42 causes the reinforcing ribs 42*c* ' . . . of the manually starting pulley 42 to act as a blade of an exhaust fan to rotate clockwise in this figure, thereby enabling hot air passing through the cover body 50 to be efficiently discharged from the ventilating exhaust duct 55*d*.

Figure 10A:
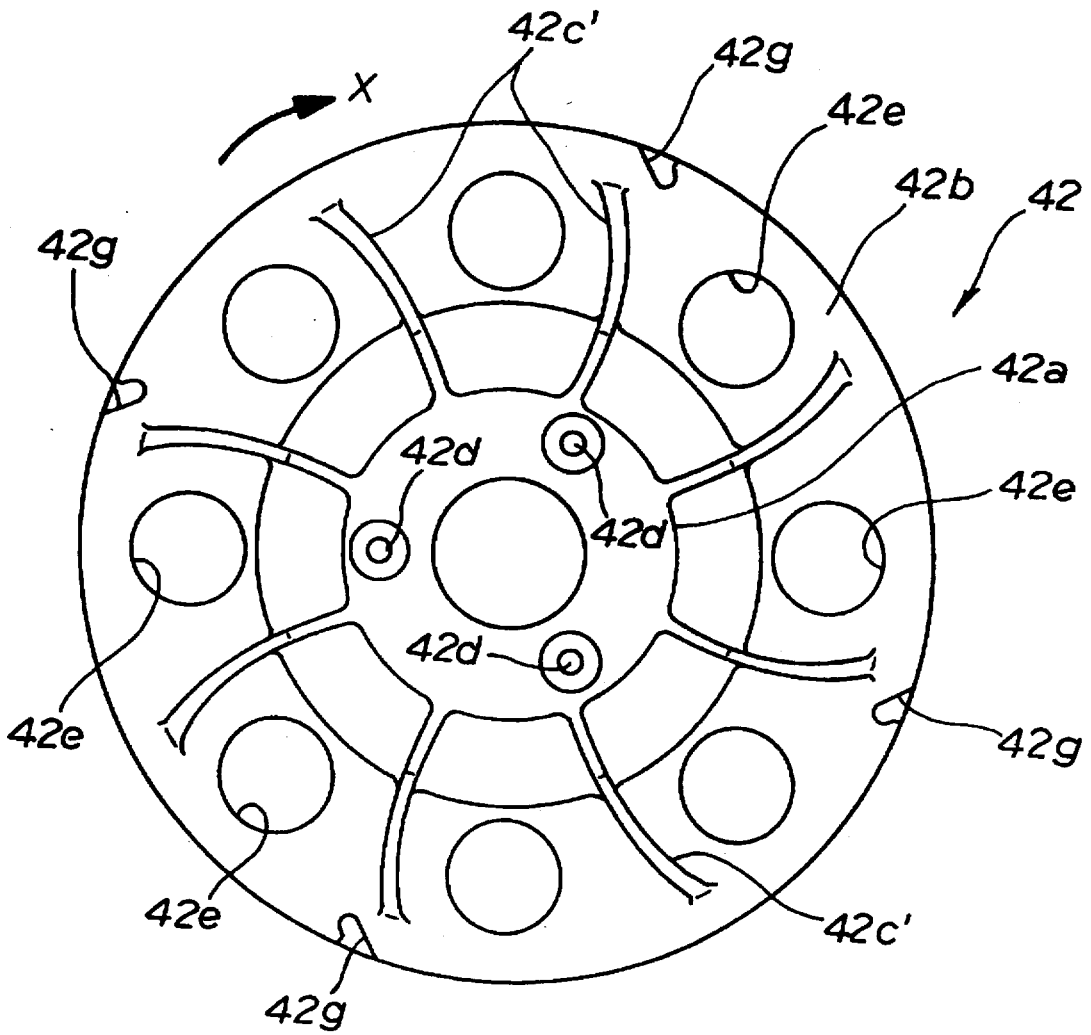
FIGS. 10A and 10B describe the configuration of the manually starting pulley according to the second embodiment of this invention.
Figure 10B:
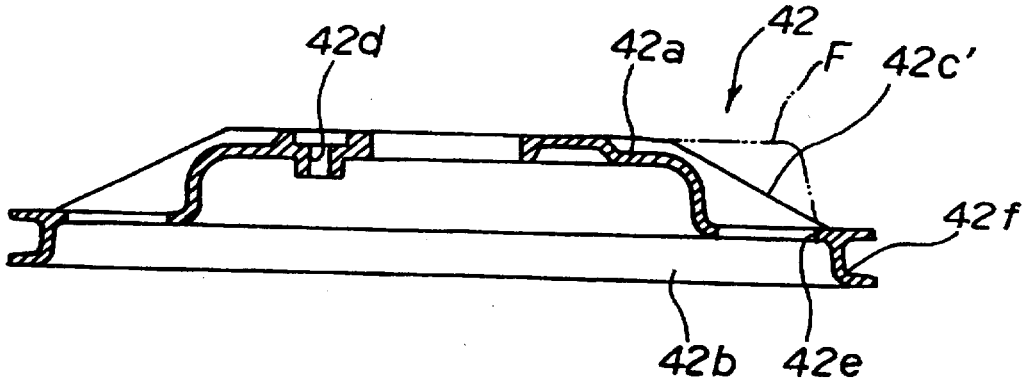

FIGS. 10A and 10B show the configuration of the manually starting pulley according to the second embodiment of this invention in plan and cross section, respectively.

The manually starting pulley 42 has a plurality of reinforcing ribs 42*c*' radially formed from the outer circumference of a base 42*a* to the neighborhood of the outer circumference of a pulley section 42*b*, and the reinforcing ribs 42*c*' . . . appear plates curved in the X direction shown by the arrow in the figure as seen from above. The reinforcing ribs 42*c*' also have a function to act as a blade of a fan.

The constitution of the second embodiment enables the amount of air exhausted to be increased because the reinforcing ribs 42*c*' . . . are curved in the X direction indicated by the arrow in the figure as seen from above.

The reinforcing ribs 42*c*' enable the amount of air exhausted to be further increased when shaped so as to extend to the upper end of the manually starting pulley 42, as shown by the imaginary line F in FIG. 10B.

With the above configuration, this invention can produce the following effects.

The cover body comprises the lower cover that covers at least the lower part of the rotating body and the upper cover coupled to the lower cover so as to cover at least part of the upper part of the rotating body. The lower cover has at least one ventilating intake port for sucking hot air located around the engine under the intake port, and the upper cover has a ventilating exhaust port for discharging the sucked hot air. Consequently, hot air existing around the engine under the lower cover can enter the ventilating intake port, pass through the cover body, and then be discharged smoothly from the ventilating exhaust duct to the outside of the engine cover, thereby preventing hot air being stranded under the lower cover.

The exhaust path formed being the lower cover and the upper cover when fitted together enables hot air passing through the cover body to be discharged smoothly along this path.

Since the rotating body includes the generator rotor mounted at the upper end of the crank shaft and the manually starting pulley mounted on one side of the generator rotor which is far from the engine and the starting pulley has a larger diameter than the generator rotor and a blade on the upper surface thereof, the manually starting pulley acts as a blade of an exhaust fan to enable hot air passing through the cover body to be discharged efficiently. Since the engine assembly comprises the engine, the crank shaft having an end extending outward from inside the engine, and the rotating body mounted at said end of the crank shaft, the rotating body includes the timing belt located near one side of the engine, the tensioner located near one side of engine and having a mounting position adjustment bolt for adjusting a tension on the timing belt, and the manually starting pulley located on one side of the engine outside the timing belt, and the starting pulley has at least one opening located so as to engage with the amounting position adjustment bolt of the tensioner, the position of the mounting position adjustment bolt can be confirmed easily by simply aligning the opening with the bolt, thereby enabling the timing belt tensioner to be adjusted easily. In addition, the manually starting pulley and the timing belt tensioner can be arranged so as to overlap each other, a sufficient mounting space for the tensioner is assured.

Since the engine assembly includes the fly wheel mounted on the other side thereof, sufficient mounting spaces for the manually starting pulley and the fly wheel are assured.

A sufficient mounting space for the generator rotor is also assured because the manually starting pulley is mounted on one side of the generator rotor mounted on one side of the engine via a mounting bolt outside the outer diameter of the crank shaft, said side of the generator motor opposed to the engine, and because the opening in the pulley is provided outside the outer diameter of the generator rotor.

What is claimed is:

1. An outboard engine assembly comprising:

an engine;

a crank shaft having an end extending outwardly from inside said engine;

a rotating body mounted at said end of the crank shaft; and a cover body mounted on said engine so as to cover said rotating body;

said cover body comprising a lower cover that covers at least a lower part of said rotating body and an upper cover that covers at least an upper part of said rotating body, said cover body including means for connecting and aligning said lower cover and said upper cover, said lower cover having at least one ventilating intake port for sucking hot air located around said engine under the intake port, said upper cover having a ventilating exhaust duct for discharging the sucked hot air.

2. An outboard engine assembly according to claim 1 wherein when said lower cover and said upper cover are fitted together, an exhaust path is formed therebetween.

3. An outboard engine assembly according to claim 1 wherein said rotating body includes a generator rotor mounted at the upper end of said crank shaft, and a manual starting pulley mounted on one side of the generator rotor which is far from said engine and wherein said starting pulley has a larger diameter than said generator rotor and also has a blade provided on an upper part for accelerating exhaustion of sucked hot air.

4. An outboard engine assembly comprising:

an engine;

a crank shaft having an end extending outward from inside said engine;

a timing belt and drive pulley engaging said crank shaft and located near one side of said engine, a tensioner located near the one side of said engine and having a mounting position adjustment bolt for adjusting tension on said timing belt, and a manual starting pulley located on the one side of said engine outside said timing belt, said starting pulley having at least one opening located so as to align with said mounting position adjustment bolt of said tensioner.

5. An outboard engine assembly according to claim 4 wherein said engine includes a fly wheel mounted thereon on a side opposite the starting pulley.

6. An outboard engine assembly according to claim 4 wherein said crank shaft has a first outer diameter and a generator rotor is mounted on the one side of said engine via a mounting bolt outside the first outer diameter of said crank shaft, said generator rotor having a second outer diameter and wherein the opening in said starting pulley is provided outside the second outer diameter of said generator rotor.

7. An outboard engine assembly comprising:

an engine;

a crank shaft having an end extending outwardly from inside said engine;

a rotating body mounted at said end of the crank shaft; and a cover body mounted on said engine so as to cover said rotating body;

said cover body comprising a lower cover that at least a lower part of said rotating body and an upper cover connected to said lower cover so as to cover at least an upper part of said rotating body, said lower cover having at least one ventilating intake port for sucking hot air located around said engine under the intake port, said upper cover having a ventilating exhaust duct for discharging the sucked hot air;

a timing belt, a tensioner having a mounting position adjustment bolt for adjusting tension on said timing belt, and a manual starting pulley located outside said timing belt, said starting pulley having at least one opening located so as to align with said mounting position adjustment bolt of said tensioner.

* * * * *

UNITED STATES PATENT AND TRADEMARK OFFICE

CERTIFICATE OF CORRECTION

PATENT NO. : 5,722,360
DATED : March 3, 1998
INVENTOR(S) : Tsunoda et al.

It is certified that error appears in the above-identified patent and that said Letters Patent is hereby corrected as shown below:

The title page should be deleted to appear as per attached title page.

Please delete columns 1-10 and substitute columns 1-10 as per attached.

Signed and Sealed this

Fifth Day of March, 2002

*Attest:*

*Attesting Officer*

JAMES E. ROGAN
*Director of the United States Patent and Trademark Office*

United States Patent [19]

Tsunoda et al.

[11] Patent Number: 5,722,360

[45] Date of Patent: Mar. 3, 1998

[54] ENGINE ASSEMBLY

[75] Inventors: Masaki Tsunoda; Mitsuharu Tanaka, both of Wako, Japan

[73] Assignee: Honda Giken Kogyo Kabushiki Kaisha, Tokyo, Japan

[21] Appl. No.: 535,642

[22] Filed: Sep. 28, 1995

[30] Foreign Application Priority Data

Sep. 28, 1994 [JP] Japan ..... 6-233818
Sep. 30, 1994 [JP] Japan ..... 6-237991

[51] Int. Cl.[6] ..... F02F 7/00

[52] U.S. Cl. ..... 123/195 P; 123/198 E; 123/185.1; 440/85; 440/900

[58] Field of Search ..... 123/198 E, 195 C, 123/185.1, 195 P; 440/88, 85, 900

[56] References Cited

U.S. PATENT DOCUMENTS 5,445,547 8/1995 Furukawa ..... 440/88

FOREIGN PATENT DOCUMENTS 59-100093 6/1984 Japan .
4-353223 12/1992 Japan .

*Primary Examiner*—Noah P. Kamen

*Attorney, Agent, or Firm*—Merchant, Gould, Smith, Edell, Welter & Schmidt, P.A.

[57] ABSTRACT

An engine assembly having a cover body mounted on the engine so as to cover a rotating body. The cover body comprises a lower cover that covers at least a lower part of the rotating body and an upper cover connected to the lower cover so as to cover at least an upper part of the rotating body; the lower cover having at least one ventilating intake port for sucking hot air located around the engine under the intake port, and the upper cover having a ventilating exhaust duct for discharging the sucked hot air. The rotating body includes a timing belt, a tensioner having a mounting position adjustment bolt, and a manual starting pulley, the starting pulley having at least one opening located so as to engage with the mounting position adjustment bolt of the tensioner. This constitution enables hot air existing around the engine under the lower cover to be discharged smoothly to the outside of the engine cover via the cover body, thereby preventing hot air from being stranded under the lower cover. In addition, the position of the mounting position adjustment bolt can be easily perceived by simply aligning the opening with the bolt.

7 Claims, 10 Drawing Sheets

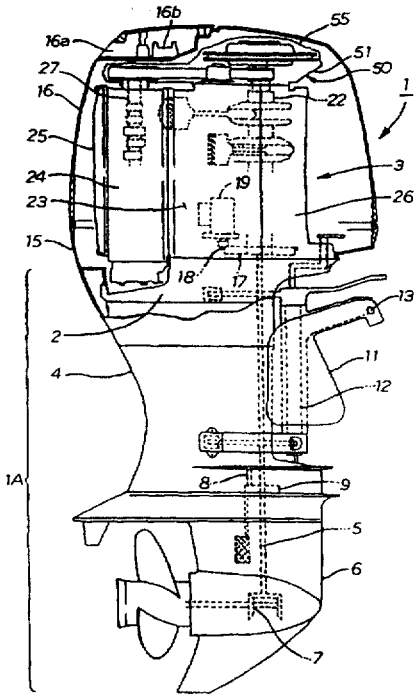

ENGINE ASSEMBLY

BACKGROUND OF THE INVENTION

1. Field of the Invention

This invention generally relates to a vertical engine for an outboard motor, and in particular, to a cover structure that covers a rotating body provided at the upper end of a crank shaft on the engine and a manually starting pulley constituting part of the rotating body.

2. Description of the Related Art

A vertical engine including a rotating body comprising a drive pulley and a driven pulley mounted at the upper end of a crank shaft protruding upward from a crank case and a cam shaft, respectively, and a timing belt extending between the drive pulley and the driven pulley is publicly known from Japanese Patent Laid-Open Publication SHO 59-100093 and Japanese Patent Laid-Open Publication HEI 4-353223.

The engine disclosed in Japanese Patent Laid-Open Publication SHO 59-100093 includes a fly wheel at the upper end of the crank shaft located further from the engine than the drive pulley. The fly wheel covered by a cover body together with the rotating body, as shown in FIG. 3 of this laid-open publication. The cover body comprises a plate-like lower cover 51 and an upper cover 54 connected to the lower cover 51 so as to cover the top of the lower cover 51 and having a ventilating exhaust duct 55 for discharging hot air in the cover body. In this configuration, however, the hot air around the engine is often stranded under the lower cover, and the stranded hot air rises from around the cover body and is then sucked into the engine again with fresh air from an intake opening in the upper part of the engine.

The engine disclosed in Japanese Patent Laid-Open Publication HEI 4-353223 includes a belt tensioner 39 disposed between a crank shaft 5 and a cam shaft 34 for adjusting a tension on a timing belt 38 with a fly wheel 41 positioned over the belt tensioner 39 (opposite to the engine) in such a way that the fly wheel 41 overlaps the belt tensioner 39, as shown in FIGS. 4 and 5 of this publication. In this configuration with the fly wheel 41 disposed over the belt tensioner 39 so as to overlap it, when the belt tensioner 39 is moved to adjust the tension on the timing belt 38, the position of a mounting position adjustment belt for fixing the belt tensioner 39 in the middle position cannot easily be confirmed easily. Thus, this configuration does not enable easy adjustment.

It is thus an object of this invention to provide a configuration to which a cover body with a lower cover is used and wherein hot air is prevented from being stranded under the lower cover.

It is another object of this invention to enable a tensioner for adjusting a tension on a timing belt to be adjusted easily even if some structure is placed over the tensioner.

SUMMARY OF THE INVENTION

To achieve the above object, a first notion of this invention provides an engine assembly comprising an engine, a crank shaft having an end extending outward from inside the engine, a rotating body mounted at said end of the crank shaft, a cover body mounted on the engine so as to cover the rotating body. The cover body comprises a lower cover that covers at least lower part of the rotating body and an upper cover connected to the lower cover so as to cover at least part of the rotating body, the lower cover having at least one ventilating intake port for sucking hot air located around the engine under the intake port, and the upper cover having a ventilating exhaust duct for discharging the sucked hot air.

When the lower cover and the upper cover are fitted together, an exhaust path is formed therebetween.

The rotating body includes a generator rotor mounted at the upper end of the crank shaft, and a manual starting pulley mounted on one side of the generator rotor which is far from the engine. The starting pulley has a larger diameter than the generator rotor and also has a blade provided on its upper part.

A second notion of this invention provides an engine assembly comprising an engine, a crank shaft having an end extending outward from inside the engine, a rotating body mounted at said end of the crank shaft, the rotating body including a timing belt located near one side of the engine, a tensioner located near one side of the engine and having a mounting position adjustment bolt for adjusting a tension on the timing belt, and a manual starting pulley located on one side of the engine outside the timing belt, the starting pulley having at least one opening located so as to engage with the mounting position adjustment bolt of the tensioner.

The engine includes a fly wheel mounted on the other side thereof.

The manual starting pulley is mounted on one side of the generator rotor mounted on one side of the engine via a mounting bolt outside the outer diameter of the crank shaft, said side of the generator motor opposed to the engine. The opening in the pulley is provided outside the outer diameter of the generator rotor.

BRIEF DESCRIPTION OF THE DRAWINGS

FIG. 1 is a side cross section of the integral part of an outboard motor according to this invention;

FIG. 2 is a side cross section of a vertical engine to which a first embodiment of this invention is applied;

FIG. 3 is an enlarged detailed drawing showing the upper part of the engine shown in FIG. 2;

FIG. 4 is a plan showing the vertical multicylinder engine shown in FIG. 2 with an engine cover, a generator rotor, and a manual starting pulley removed;

FIGS. 5A and 5B are plan views of the integral part of a lower cover and an upper cover that constitute a cover body to the first embodiment of this invention;

FIG. 6 is a cross section of the connection between the lower cover and the upper cover;

FIGS. 7A and 7B are a plan view and a side cross-sectional view, respectively, of the constitution of the manual starting pulley according to the first embodiment of this invention;

FIG. 8 is a schematic perspective view of a cover body according to a second embodiment of this invention;

FIG. 9 is a plan showing a vertical multicylinder engine to which the second embodiment of this invention is applied with an engine cover, a generator rotor, and a manual starting pulley removed; and FIGS. 10A and 10B are a plan view and a side cross-sectional view, respectively, of the configuration of the manual starting pulley according to the second embodiment of this invention.

DETAILED DESCRIPTION OF THE PREFERRED EMBODIMENTS

A preferred embodiment of this invention is described below in detail with reference to the accompanying drawings.

First, an embodiment according to a first notion of this invention is described in detail with reference to FIGS. 1 to 7. Referencing FIG. 1, the integral part of an outboard motor according to this invention is shown. Outboard motor 1 includes an outboard motor main body 1A comprising a vertical multicylinder engine 3 placed on a mount case 2 and coupled thereto with bolts. An extension case 4 is coupled to the bottom of the mount case 2 with bolts. A vertical drive shaft 5 housed in the extension case 4. A bevel gear set 7 is housed in a gear case 6 bonded to the bottom of the extension case 4, and a cooling water supply pipe 8 and a water pump 9 are housed in the extension case 4 and gear case 6. An outboard motor mounting means 11 is elastically supported by and coupled to the outboard motor 1A via a mount rubber.

The outboard motor mounting means 11 is a fixture for fixing the outboard motor 1 to a hull, not shown. The mounting means can oscillate the outboard motor main body 1A around a swivel shaft 12 in the lateral direction as shown from above and spring the outboard motor main body 1A including the swivel shaft 12 clockwise in the drawing around a tilt shaft 13.

The outboard motor main body 1A also includes an under case 15 that forms an engine room which accommodates an engine 3, and an engine cover 16 that can be attached to and removed from the under case 15. The under case 15 is supported by the mount case 2. Reference numeral 16*a* designates an air intake port which leads to the intake port of the engine 3 via an air intake duct 16*b*.

A fly wheel 17 is mounted below a crank shaft 22, and linked to a starter motor 19 via a ring gear 18 provided on the outer diameter of the fly wheel 17.

FIG. 2 is a side cross section of a vertical multicylinder engine according to a first embodiment of this invention. This vertical multicylinder engine 3 comprises, for example, a four cylinder engine with each cylinder 21 arranged so that its axis extends approximately horizontally. A crank shaft 22 is vertically arranged. A cylinder block 23 and a cylinder head 24 are joined together on an approximately vertical surface, and a movable valve chamber 25*a* comprising a cylinder head 24 and a head cover 25 has a cam shaft 27 and a locker shaft 28 housed therein.

Reference numerals 26 and 29 designate pistons inserted into a crank case and the cylinder 21. Although not shown, the inside of the cylinder block 23 is in communication with the movable valve chamber 25*a*.

The upper part of the crank shaft 22 protrudes from the cylinder block 23, while the upper part of the cam shaft 27 protrudes from the cylinder head 24.

A timing belt 33 is installed between a crank shaft pulley 31 mounted on the top of the crank shaft 22 and a cam shaft pulley 32 mounted on the top of the cam shaft 27. Appropriate tension is applied to the timing belt 33 via a timing belt tensioner 34.

A manual starting pulley 42 is mounted on the top of the crank shaft 22 outside the timing belt 33 via an AC general rotor 41.

The diameter of a rotor 41 is larger than that of the crank shaft 22 and smaller than that of a fly wheel 17 described below. The rotor 41 has an inverted U shape that opens downwardly. The rotor 41 is attached to the crank shaft 22 via a bolt 22*a* in such a way that the rotor 41 and the crank shaft 22 rotate simultaneously.

The crank shaft pulley 31, the cam shaft pulley 32, the timing belt 33, the tensioner 34, the rotor 41, and the manual starting pulley 42 are covered by a cover body 50 comprising an upper cover 55 and a lower cover 51.

The crank shaft 22 has the fly wheel 17 attached to the lower part thereof and the fly wheel 17 is linked to the starter motor 19 (FIG. 1) with the ring gear 18 provided on the outer circumference of the fly wheel.

The crank shaft pulley 31, the timing belt 33, the rotor 41, and the manually starting pulley 42 are collectively referred to as a "rotating body A" mounted at the upper end of the crank shaft 22.

FIG. 3 is an enlarged detailed drawing showing the upper part of the engine shown in FIG. 2. The cover body 50 comprises a lower cover 51 mounted on the cylinder block 23 so as to cover at least part of the rotating body A, and an upper cover 55 attached to the lower cover 51 so as to cover at least the upper part of the rotating body A.

The lower cover 51 comprises a bottom 51*a*, a peripheral wall 51*b* installed so as to surround the bottom 51*a*, a first aperture 51*c* and a second aperture 51*d* which open in the bottom 51*a*, and a plurality of ventilating intake ports 51*e* which suitably open around the first aperture 51*c* in the bottom 51*a*.

The first aperture 51*c* allows the crank shaft 22 and the tensioner 34 to be inserted thereinto, and the second aperture 51*d* allows the cam shaft 27 to be inserted thereinto.

The cover body 50 are mounted on the cylinder block 23, the cylinder head 24, and the crank case 26 by fitting to the upper ends the edge of the lower cover 51 that defines the first aperture 51*c* and the second aperture 51*d*. Part of the bottom 51*a* extends obliquely upward to form the peripheral wall 51*b*.

The upper cover 55 is shaped so as to correspond to the lower cover 51 as seen from above, and comprise a hood 55*a* and a peripheral wall 55*b* surrounding the hood 55*a*.

FIG. 4 is a plan showing the vertical multicylinder engine in FIG. 2 with the engine cover, the generator rotor, and the manual starting pulley removed. As shown in the figure, the tensioner 34 is mounted on the upper outer surface of the cylinder block 23 with a mounting position adjustment bolt 35 for adjusting tension on the timing belt 33. The tension on the timing belt 33 can be adjusted by adjusting the engaging lock relationship between the mounting position adjustment bolt 35 and a long aperture 34*a* in the tensioner 34.

Reference numeral 36 designates a coil spring that urges the tensioner 34 against the timing belt 33.

An intake muffling box 44, throttle valve devices 45, and an intake manifold 46 are disposed on one side of the cylinder block 23.

Reference numerals 47 and 48 designate a blowy gas reflux tube in communication with the head cover 25 and the intake muffling box 44 and an electrical equipment box (not shown) for housing an ignition coil and a CDI unit.

FIGS. 5A and 5B are plan views showing the integral part of the lower and upper covers according to the first embodiment of this invention, respectively. As shown in FIG. 5A, the lower cover 51 comprises a bulkhead section 51*f* extending inward from a peripheral wall section 51*b* so as to stand from the bottom 51*a*. A plurality of flanges 51*g* are formed on the outer surface of the peripheral wall section 51*b*. Bolt locking apertures 51*h* are formed in the flanges 51*g* . A plurality of engagingly locking convexes 51*i* are formed on the outer surface of the peripheral wall section 51*b*.

The space formed between the peripheral wall section 51*b* and the bulkhead section 51*f* is a lower exhaust path 51*j* constituting part of a ventilating exhaust duct described below.

As shown in FIG. 5B, the upper cover 55 includes an upper exhaust path 55*c* extending opposite to the lower exhaust path 51*j* of the lower cover 51. A ventilating exhaust duct 55*d* opens upward at the tip of the upper exhaust path 55*c*. Flanges 55*f* have bolt locking apertures 55*e* formed and located so as to correspond to the bolt locking apertures 51*h* in the lower cover 51. A fitting recess 55*g* is snap-fitted to the engagingly locking convex 51*i* of the lower cover 51. It is noted that at least some of the ventilating intake ports 51*e* (FIG. 3) may be provided in the lower cover 51 and that some of them may be provided in the upper cover 55.

At least part of the ventilating exhaust duct 55*d* may be provided in the upper cover 55 and part of it may be provided in the lower cover 51.

In addition, the ventilating exhaust duct 55*d* is partially provided in the lower cover 51, and cooperates with the upper cover 55 to form an exhaust path. That is, the exhaust path is formed by the cooperation between the lower exhaust path 51*j* and the upper exhaust path 55*c* when the lower cover 51 is placed on the upper cover 55.

FIG. 6 shows in cross section the connection between the lower cover 51 and the upper cover 55 according to the first embodiment of this invention. The lower cover 51 has a convex projection 51*k* at the upper edge of the peripheral wall section 51*b* thereof, while the upper cover 55 has formed at the lower edge of the peripheral wall section 55*b* a recess 55*h* into which the convex projection 51*k* of the peripheral wall section 51*b* is fitted. In this way, the lower cover 51 and the upper cover 55 can be aligned or coupled together easily.

FIGS. 7A and 7B show the configuration of the manual starting pulley according to the first embodiment of this invention in plan and cross section, respectively.

The manual starting pulley 42 comprises a base 42*a* located in the middle and formed so as to have a larger diameter than the generator rotor 41 (FIG. 3). The starting pulley has and approximately inverted U shape as seen laterally. A disc-like pulley section 42*b* formed on the lower outer circumference of the base 42*a*. A plurality of reinforcing ribs 42*c* are radially formed from the outer circumference of the base 42*a* to the neighborhood of the outer circumference of the pulley section 42*b*. A plurality of bolt insertion apertures 42*d* formed in the upper surface of the base 42*a*. A plurality of openings (round apertures) 42*e* vertically penetrate the pulley section 42*b*. A winding groove 42*f* formed in the outer circumference of the pulley section 42*b*. A plurality of hook recesses 42*g* are formed on the outer circumference of the upper surface of the pulley section 42*b*.

The reinforcing ribs 42*c* appear as vertical plates as seen from above. The bolt insertion apertures 42*d* allow insertion of a bolt for fixing a starting pulley to the generator rotor 41. The openings 42*e* are arranged outside the outer diameter of the rotor 41. The winding groove 42*f* allows a starting rope (not shown) to be wound therearound, and the hook recesses 42*g* allow the end of the starting rope to be engagingly locked therein. The reinforcing ribs 42*c* also act as a blade of a fan.

The bolt insertion apertures 42*d* correspond to mounting bolt apertures provided in the rotor 41 outside the diameter of the crank shaft 22.

In addition, the plurality of openings 42*e* are disposed at a pitch that enables them to engage with the mounting position adjustment bolt 35 of the timing belt tensioner 34.

Furthermore, as shown in FIG. 4, for example, a timing mark X may be provided on the engine block side of the lower cover 51 and a timing mark Y may be provided on the starting pulley 42 so that the opening 42*e* in the starting pulley 42 can be positioned over the mounting position adjustment bolt 35 by aligning the marks X, Y with each other. The mounting position adjustment bolt 35 varies according to the position of the tensioner 34, and the opening 42*e* has a width that allows the access and operation of a tool for loosening and tightening the bolt 35. The alignment of the timing marks X, Y enables the crank shaft 22 to be set at the upper dead point.

Next, the operation of the engine of the above configuration is described.

Referencing FIG. 1, the crank shaft 22 is usually started using the a starter motor 19, the ring gear 18, and the fly wheel 17.

With reference to FIG. 3, to manually start the crank shaft 22, the engine cover 16 and the upper cover 55 are removed, the starting rope (not shown) is wound around the manual starting pulley 42, and the pulley is then rotated using the rope.

During the rotation of the crank shaft 22, the rotor 41 also rotates to cause the AC generator to generate electricity.

The cam shaft 27 is accurately driven by the crank shaft 22 via the crank shaft pulley 31, the timing belt 33, and the cam shaft pulley 32.

The timing belt 33 has an appropriate tension applied thereto by the timing belt tensioner 34.

Next, the operation of the cover body 50 is described with reference to FIG. 3.

Hot air existing around the engine 3 under the lower cover 51 enters the ventilating intake ports 51*e*, passes through the cover body 50 and the exhaust path comprising the lower exhaust path 51*j* and the upper exhaust path 55*c* shown in FIGS. 5A and 5B, and is then discharged from the ventilating exhaust duct 55*d* to the outside of the engine cover 16. This prevents hot air being stranded under the lower cover 51.

In addition, the rotation of the manual starting pulley 42 causes the reinforcing ribs 42*c* of the manual starting pulley 42 to act as a blade of an exhaust fan to rotate clockwise in FIG. 4, thereby enabling hot air passing through the cover body 50 to be efficiently discharged from the ventilating exhaust duct 55*d*.

Next, the procedure for adjusting the timing belt tensioner 34 is explained.

First, the engine cover 16 and the upper cover 55 shown in FIG. 3 are removed, and one of the openings 42*e* is aligned with the mounting position adjustment bolt 35 by manually rotating the manual starting pulley 42 to match the marks X, Y. The position of the mounting position adjustment bolt 35 is confirmed through the opening 42*e*. Then, a tool is used to access the opening 42*e* and the lateral bottom of the starting pulley 42, to loosen the mounting position adjustment bolt 35 in order to adjust the position of the tensioner 34, thereby applying an appropriate tension to the timing belt 33. Finally, the mounting position adjustment bolt is tightened, and the upper cover 55 and the engine cover 16 are mounted to complete the adjustment.

A variation of the cover body 50 according to the first embodiment is described with reference to FIG. 8.

FIG. 8 is a schematic perspective view of a cover body according to a second embodiment of this invention. A cover body 50 has a lower cover 51, and an upper cover 55 coupled to the lower cover 51 via hinges 58 . This constitution reduces the number of bolting and snap fitting sites between the lower cover 51 and the upper cover 55, thereby enabling the cover body 50 to be opened and closed easily.

The ventilating exhaust duct 55*d* is located furthest relative to the line segment CL joining the center of the crank shaft 22 with the center of the cam shaft 27 (L1>L2). The upper cover 55 can be widely opened because the hinges 58 are disposed on the side of the upper cover on which the ventilating exhaust duct 55*d* is provided and the fitting recess 55*g* is disposed on the other side of the upper cover opposite the ventilating exhaust duct 55*d*.

Next, the second embodiment of this invention is described with reference to FIGS. 9 to 10B. The corresponding components carry the same reference numerals as in the first embodiment, and their description is omitted.

FIG. 9 is a plan showing a vertical multicylinder engine to which the second embodiment of this invention is applied with an engine cover, a generator rotor, and a manual starting pulley removed.

The rotation of the manually starting pulley 42 causes the reinforcing ribs 42*c*' of the manual starting pulley 42 to act as a blade of an exhaust fan to rotate clockwise in this figure, thereby enabling hot air passing through the cover body 50 to be efficiently discharged from the ventilating exhaust duct 55*d*.

FIGS. 10A and 10B show the configuration of the manual starting pulley according to the second embodiment of this invention in plan and cross section, respectively.

The manual starting pulley 42 has a plurality of reinforcing ribs 42*c*' radially formed from the outer circumference of a base 42*a* to the neighborhood of the outer circumference of a pulley section 42*b*. The reinforcing ribs 42*c*' appear as plates curved in the X direction shown by the arrow in the figure as seen from above. The reinforcing ribs 42*c*' also have the function of acting as blades of a fan.

The constitution of the second embodiment enables the amount of air exhausted to be increased because the reinforcing ribs 42*c*' are curved in the X direction.

The reinforcing ribs 42*c*' enable the amount of air exhausted to be further increased when they are shaped so as to extend to the upper end of the manual starting pulley 42, as shown by the imaginary line F in FIG. 10B.

With the above configuration, this invention can produce the following effects.

The cover body comprises the lower cover that covers at least the lower part of the rotating body. The upper cover is coupled to the lower cover so as to cover at least part of the upper part of the rotating body. The lower cover has at least one ventilating intake port for sucking hot air located around the engine under the intake port. The upper cover has a ventilating exhaust port for discharging the hot air. Consequently, hot air existing around the engine under the lower cover can enter the ventilating intake port, pass through the cover body, and then be discharged smoothly from the ventilating exhaust duct to the outside of the engine cover, thereby preventing hot air being stranded under the lower cover.

The exhaust path being formed by the lower cover and the upper cover when fitted together enables hot air passing through the cover body to be discharged smoothly along this path.

Since the rotating body includes the generator rotor mounted at the upper end of the crank shaft and the manual starting pulley mounted on one side of the generator rotor which is remote from the engine, and since the starting pulley has a larger diameter than the generator rotor and a blade on the upper surface thereof, the manual starting pulley acts as a blade of an exhaust fan to enable hot air passing through the cover body to be discharged efficiently. Since the engine assembly comprises the engine, the crank shaft having an end extending outward from inside the engine, and the rotating body mounted at said end of the crank shaft, the rotating body includes the timing belt and the tensioner having a mounting position adjustment bolt for adjusting a tension on the timing belt, both located near one side of the engine, and the manual starting pulley also located on one side of the engine outside the timing belt, and the starting pulley having at least one opening located so as to engage with the mountiung position adjustment bolt of the tensioner, the position of the mounting position adjustment bolt can be confirmed easily by simply aligning the opening with the bolt, thereby enabling the timing belt tensioner to be adjusted easily. In addition, the manual starting pulley and the timing belt tensioner can be arranged so as to overlap each other, and a sufficient mounting space for the tensioner is assured.

Since the engine assembly includes the fly wheel mounted on the other side thereof opposite the rotating body, sufficient mounting spaces for the manual starting pulley and the fly wheel are assured.

A sufficient mounting space for the generator rotor is also assured because the manual starting pulley is mounted on one side of the generator rotor mounted on one side of the engine via a mounting bolt outside the outer diameter of the crank shaft, said side of the generator motor being opposed to the engine, and because the opening in the pulley is provided outside the outer diameter of the generator rotor.

What is claimed is:

1. An outboard engine assembly comprising:

an engine;

a crank shaft having an end extending outwardly from inside said engine;

a rotating body mounted at said end of the crank shaft; and a cover body mounted on said engine so as to cover said rotating body;

said cover body comprising a lower cover that covers at least a lower part of said rotating body and an upper cover that covers at least an upper part of said rotating body, said cover body including means for connecting and aligning said lower cover and said upper cover, said lower cover having at least one ventilating intake port for sucking hot air located around said engine under the intake port, said upper cover having a ventilating exhaust duct for discharging the sucked hot air.

2. An outboard engine assembly according to claim 1 wherein when said lower cover and said upper cover are fitted together, an exhaust path is formed therebetween.

3. An outboard engine assembly according to claim 1 wherein said rotating body includes a generator rotor mounted at the upper end of said crank shaft, and a manual starting pulley mounted on one side of the generator rotor which is far from said engine and wherein said starting pulley has a larger diameter than said generator rotor and also has a blade provided on an upper part for accelerating exhaustion of sucked hot air.

4. An outboard engine assembly comprising:

an engine;

a crank shaft having an end extending outward from inside said engine;

a timing belt and drive pulley engaging said crank shaft and located near one side of said engine, a tensioner located near the one side of said engine and having a mounting position adjustment bolt for adjusting tension on said timing belt, and a manual starting pulley located on the one side of said engine outside said timing belt, said starting pulley having at least one opening located so as to align with said mounting position adjustment bolt of said tensioner.

5. An outboard engine assembly according to claim 4 wherein said engine includes a fly wheel mounted thereon on a side opposite the starting pulley.

6. An outboard engine assembly according to claim 4 wherein said crank shaft has a first outer diameter and a generator rotor is mounted on the one side of said engine via a mounting bolt outside the first outer diameter of said crank shaft, said generator rotor having a second outer diameter and wherein the opening in said starting pulley is provided outside the second outer diameter of said generator rotor.

7. An outboard engine assembly comprising:

an engine;

a crank shaft having an end extending outwardly from inside said engine;

a rotating body mounted at said end of the crank shaft; and a cover body mounted on said engine so as to cover said rotating body;

said cover body comprising a lower cover that at least a lower part of said rotating body and an upper cover connected to said lower cover so as to cover at least an upper part of said rotating body, said lower cover having at least one ventilating intake port for sucking hot air located around said engine under the intake port, said upper cover having a ventilating exhaust duct for discharging the sucked hot air;

a timing belt, a tensioner having a mounting position adjustment bolt for adjusting tension on said timing belt, and a manual starting pulley located outside said timing belt, said starting pulley having at least one opening located so as to align with said mounting position adjustment bolt of said tensioner.

* * * * *